United States Patent [19]

Igarashi et al.

[11] 4,163,700

[45] Aug. 7, 1979

[54] METHOD FOR STABILIZING TIN OR TIN ALLOY ELECTROPLATING BATHS

[75] Inventors: Shuji Igarashi; Yoshikazu Fujisawa; Toshio Igarashi, all of Tokyo, Japan

[73] Assignee: Dipsol Chemicals Co., Ltd., Tokyo, Japan

[21] Appl. No.: 952,204

[22] Filed: Oct. 17, 1978

[30] Foreign Application Priority Data

Oct. 21, 1977 [JP] Japan ..... 52-125865

[51] Int. Cl.[2] ..... C25D 3/32; C25D 3/60

[52] U.S. Cl. ..... 204/43 S; 204/44; 204/54 R; 204/54 L

[58] Field of Search ..... 204/43 S, 44, 54 R, 204/54 L, 120, 121, 122, 123; 106/1.12, 1.22, 1.25

[56] References Cited

U.S. PATENT DOCUMENTS

| | | | |
|---|---|---|---|
| 3,616,291 | 10/1971 | Wilson | 204/43 S X |
| 3,951,760 | 4/1976 | Fueki et al. | 204/43 S |
| 4,021,316 | 5/1977 | Fueki et al. | 204/43 S |

FOREIGN PATENT DOCUMENTS

| | | | |
|---|---|---|---|
| 75632 | 6/1976 | Japan | 204/43 S |
| 25550 | of 1903 | United Kingdom | 204/120 |

*Primary Examiner*—G. L. Kaplan

*Attorney, Agent, or Firm*—Birch, Stewart, Kolasch & Birch

[57] ABSTRACT

A method for stabilizing tin or tin alloy electroplating baths containing citric acid or its salt and an ammonium salt, by adding at least one saturated hydroxycarboxylic acid or its salt other than citric acid or citrate and/or at least one saturated dibasic carboxylic acid.

8 Claims, No Drawings

METHOD FOR STABILIZING TIN OR TIN ALLOY ELECTROPLATING BATHS

The present invention relates to an electrodeposition of tin or tin alloy on an article of a material such as metal, ceramics, glass or the like and more particularly to a method for stabilizing tin or tin alloy electroplating baths which contain citric acid or its salt and ammonium salt.

The electrodeposition of tin or tin alloy has widely been employed to protect steel or the like metal material from corrosion, or to give soldering ability to or improve the same of various base materials.

For tin electroplating, hitherto, an acidic bath such as sulfuric acid bath or a basic bath such as sodium hydroxide bath has conventionally been employed. When the sulfuric acid bath is used, a homogeneous electrodeposition of tin would not be attained. In order to overcome this defect, a relatively large amount of surface active agent should be added in the bath but this causes bubbling in the bath so as to adversely affect on the plating efficiency and the working environment. When the sodium hydroxide bath is used, the bath must be heated to about 70° C. to be similarly bubbled which causes the same defects. In this bath, further, the ionized tin in the bath is of tetravalency which means that a higher current efficiency cannot be attained.

For tin alloy electroplating, sulfate, pyrophosphate, borofluoride, sodium stannate, alkali cyanide, gluconate and the like baths have been proposed. Among those, sulfate, borofluoride and alkali cyanide baths require a special treatment for making the same harmless, when discharged as waste liquid. The pyrophosphate, borofluoride, alkali cyanide and gluconate baths have a disadvantage of that the composition of plated alloy is adversely varied in a relatively wide range due to fluctuation of current density during the electroplating. Further, borofluoride, alkali cyanide and sodium stannate baths do not show a desired high plating efficiency.

In order to overcome the disadvantages as referred to, a bath containing citric acid or its salt and an ammonium salt has been proposed (see, for instance, USSR Inventor's Certificate No. 293 876).

It has been found, however, that such citric acid containing electroplating bath is still disadvantageous in that when a metallic ion concentration in the bath gradually increases as the charged current is made large, the composition of the electroplating bath loses the balance, regardless of a shape and outer surface area of an anode and that an insoluble substance to be considered as stannate or other metallic salts is formed on the anode of tin or tin alloy plate and then released therefrom to adhere on the cathode to be plated with tin or tin alloy which gives undesirable effect on the plated surface.

Therefore, a principal object of the present invention is to obviate and overcome the disadvantages referred to in such conventional tin or tin alloy electroplating baths which contain citric acid or its salt and an ammonium salt.

A specific object of the invention is to provide a method for stabilizing such tin or tin alloy electroplating baths by preventing any excess elution of metallic ion or ions from a tin or tin alloy anode into the bath.

Another specific object of the invention is to inhibit any formation of insoluble substance on the anode to attain a desired fine electroplating and to prevent any excess consumption of the anode.

According to the invention, the above objects and other objects to be appreciated by fully understanding the invention can be attained by adding in the bath at least one saturated hydroxycarboxylic acid or its salt other than citric acid and citrate and/or at least one saturated dibasic carboxylic acid or its salt.

As the unsaturated hydroxycarboxylic acids and salts thereof, tartaric acid, malic acid, glycollic acid, glyceric acid, lactic acid, $\beta$-hydroxypropionic acid and the like as well as sodium, potassium and ammonium salts of these acids may be employed solely or as a mixture thereof. As the unsaturated dibasic carboxylic acids and salts thereof, oxalic acid, malonic acid, succinic acid, glutaric acid, adipic acid and the like as well as sodium, potassium and ammonium salts of these acids may be employed solely or as a mixture thereof.

The stabilizer consisting of either a sole compound or a mixture uded in the invention is added in the bath in the amount of 5 to 30 g/l.

It is preferable to set pH value of the electroplating bath within a range of 4 to 8, and more particularly about at 6, since if the base material to be electroplated is a ceramic composite which has recently been employed as various parts for electronic instruments, the material may be damaged with a strong acid or base.

For attaining an electrodeposition of bright tin or tin alloy, a conventional brightener may be added in the bath in addition to the stabilizer.

The correct mechanism by which the stabilizer effectively acts in the tin or tin alloy electroplating bath containing citric acid or its salt and an ammonium salt has not yet sufficiently been elucidated but this is considered by the inventors to be due to a difference in the ability for dissolving tin or tin alloy or forming the complex therewith between the citric acid and the stabilizer. In other words, citric acid or its salt forms the complex with tin or tin alloy in the bath to elute tin or tin alloy at a relatively high velocity, whereby the elution velocity at the anode becomes higher than the electrodepositing velocity at the cathode to lose the material balance in the bath. The stabilizer, however, has the lower ability of forming the complex with tin or tin alloy than that of citric acid or its salt so that the addition of such stabilizer results in lowering tin or tin alloy elution velocity at the anode to keep the material balance in the bath.

The invention will now be further detailedly explained with reference to following examples and comparative tests which are given for the purpose of illustration only. General conditions not specified in the respective examples and tests are as follows:

| | |
|---|---|
| Electroplating temperature: | 15° to 25° C. |
| Anode current density: | 2 A/dm$^2$ |
| Cathode current density: | 2 A/dm$^2$ |
| Cathode: | Fe plate (degreased and cleaned) |

Brightener: 10% aqueous solution of a water-soluble polymer obtained by reacting imino-bis-propylamine with diethyl malonate and then reacting the resulting reaction product with phthalic anhydride.

In the examples, there was found almost no insoluble material to be released from the anode.

In the comparative tests, pH control in the electroplating bath was made by adding therein aqueous ammonia solution.

EXAMPLE 1

| Tin Plating | |
|---|---|
| Anode: Sn Plate | |
| Composition of bath: | |
| $SnSO_4$ | 50 g/l |
| Citric acid | 90 g/l |
| $(NH_4)_2SO_4$ | 70 g/l |
| Ammonium tartrate | 9 g/l |
| 30% aqueous solution of ammonia | 120 g/l |
| Brightener | 8 ml/l |
| pH of bath: 6.0 | |

The plating bath was prepared by dissolving the constituents in water, and the plating was carried out to obtain a steel plate with a well plated tin.

COMPARATIVE TEST 1

An electroplating bath A just same with that in Example 1 and a bath B similar thereto but not including ammonium tartrate were prepared. For comparing change of tin ion concentration in the baths due to change of charging current, tests were carried out to obtain following results.

| Current charged (AN/l) | 0 | 20 | 40 | 60 | 80 | 100 | 120 |
|---|---|---|---|---|---|---|---|
| A Sn (g/l) | 26 | 30 | 32 | 29 | 31 | 30 | 29 |
| B Sn (g/l) | 26 | 35 | 40 | 45 | 47 | 43 | 49 |

EXAMPLE 2

| Tin Plating | |
|---|---|
| Anode: Sn plate | |
| Composition of bath: | |
| $SnSO_4$ | 50 g/l |
| Citric acid | 90 g/l |
| $(NH_4)_2SO_4$ | 70 g/l |
| Malic acid | 8 g/l |
| 30% aqueous solution of ammonia | 120 g/l |
| Brightener | 8 ml/l |
| pH of bath: 6.0 | |

The plating was carried out to obtain a steel plate with a well plated tin layer.

COMPARATIVE TEST 2

An electroplating bath C just same with that in Example 2 and a bath D similar thereto but not including malic acid were prepared. The tests similar to those in Comparative Test 1 were carried out to obtain following results.

| Current charged (AH/l | 0 | 20 | 40 | 60 | 80 | 100 | 120 |
|---|---|---|---|---|---|---|---|
| C Sn (g/l) | 26 | 31 | 30 | 32 | 29 | 30 | 31 |
| D Sn (g/l) | 26 | 35 | 40 | 45 | 47 | 43 | 49 |

EXAMPLE 3

| Tin-Zinc Plating | |
|---|---|
| Anode: Sn-Zn (75 : 25) alloy plate | |
| Composition of bath: | |
| $SnSO_4$ | 38 g/l |
| $ZnSO_4 . 7H_2O$ | 32 g/l |
| Citric acid | 77 g/l |
| $(NH_4)_2SO_4$ | 66 g/l |
| Tartaric acid | 18 g/l |
| 30% aqueous solution of ammonia | 72 g/l |
| Brightener | 8 ml/l |
| pH of bath: 6.0 | |

The plating was carried out to obtain a steel plate with a well plated tin-zinc alloy layer (Sn-Zn ratio: 75:25).

COMPARATIVE TEST 3

An electroplating bath E just same with that in Example 3 and a bath F similar thereto but not including tartaric acid were prepared. For comparing tin and zinc ion concentrations in the baths to be varied depending on charged current, tests were carried out to obtain following results.

| Current charged (AH/l) Kinds of ion | 0 Sn Zn g/l | 20 Sn Zn g/l | 40 Sn Zn g/l | 60 Sn Zn g/l | 80 Sn Zn g/l | 100 Sn Zn g/l | 120 Sn Zn g/l |
|---|---|---|---|---|---|---|---|
| E | 21 6 | 22 7.5 | 22 7 | 23 7 | 24 8 | 24 8 | 23 7 |
| F | 21 6 | 30 8 | 37 10 | 40 11 | 41 15 | 35 12 | 37 16 |

EXAMPLE 4

| Tin-Lead Plating | |
|---|---|
| Anode: Sn-Pb (65 : 35) alloy plate | |
| Composition of bath: | |
| $SnSO_4$ | 33 g/l |
| $Pb(OOCCH_3)_2 . 3H_2O$ | 18 g/l |
| Ammonium hydrogen citrate | 110 g/l |
| $NH_4Cl$ | 100 g/l |
| Lactic acid | 18 g/l |
| 30% aqueous solution of ammonia | 100 g/l |
| Brightener | 8 ml/l |
| pH of bath: 6.0 | |

The plating was carried out to obtain a steel plate with a well plated Sn-Pb alloy layer (Sn-Pb ratio: 65:35).

COMPARATIVE TEST 4

An electroplating bath G just same with that in Example 4 and a bath H similar thereto but not including lactic acid were prepared. The tests similar to those in Comparative Test 3 were carried out to obtain following results.

| Current charged (AH/l) Kinds of ion | 0 Sn Pb g/l | 20 Sn Pb g/l | 40 Sn Pb g/l | 60 Sn Pb g/l | 80 Sn Pb g/l | 100 Sn Pb g/l | 120 Sn Pb g/l |
|---|---|---|---|---|---|---|---|
| G | 18 10 | 19 10 | 20 11 | 18 9 | 21 11 | 20 11 | 19 11 |
| H | 18 10 | 22 13 | 25 15 | 29 16 | 32 15 | 35 18 | 38 19 |

EXAMPLE 5

| Tin-Copper Plating | |
|---|---|
| Anode: Sn-Cu (70 : 30) alloy plate | |
| Composition of bath: | |
| $SnSO_4$ | 22 g/l |
| $CuSO_4 . 5H_2O$ | 25 g/l |
| Ammonium hydrogen citrate | 100 g/l |
| $(NH_4)_2SO_4$ | 80 g/l |
| Glycollic acid | 20 g/l |
| 30% aqueous solution of ammonia | 75 g/l |
| Brightener | 8 ml/l |
| pH of bath: 6.2 | |

The plating was carried out to obtain a steel plate with a well plated Sn-Cu alloy layer (Sn-Cu ratio: 70:30).

COMPARATIVE TEST 5

An electroplating bath I just same with that in Example 5 and a bath J similar thereto but not including glycollic acid were prepared. The tests similar to those in Comparative Test 3 were carried out to obtain following results.

| Current charged (AH/l) Kinds of ion | 0 Sn Cu g/l | 20 Sn Cu g/l | 40 Sn Cu g/l | 60 Sn Cu g/l | 80 Sn Cu g/l | 100 Sn Cu g/l | 120 Sn Cu g/l |
|---|---|---|---|---|---|---|---|
| I | 12 6.0 | 15 6.8 | 15 6.2 | 14 6.0 | 14 .58 | 13 5.8 | 12 5.6 |
| J | 12 6.0 | 17 9.4 | 18 9.4 | 20 8.3 | 25 8.5 | 26 9.0 | 27 9.0 |

EXAMPLE 6

| Tin-Zinc Plating | |
|---|---|
| Anode: Sn-Zn (75 : 25) alloy plate | |
| Composition of bath: | |
| $SnSO_4$ | 28 g/l |
| $ZnSO_4 . 7H_2O$ | 24 g/l |
| Ammonium citrate | 90 g/l |
| Succinic acid | 10 g/l |
| Ammonium tartrate | 5 g/l |
| Ammonium phosphate | 80 g/l |
| 30% aqueous solution of ammonia | 80 g/l |
| Brightener | 8 ml/l |
| pH of bath: 5.8 | |

The plating was carried out to obtain a steel plate with a well plated Sn-Zn alloy layer (Sn-Zn ratio: 75:25).

COMPARATIVE TEST 6

An electroplating bath K just same with that in Example 6 and a bath L similar thereto but not including succinic acid and ammonium tartarate were prepared. The tests similar to those in Comparative Test 3 were carried out to obtain following results.

| current charged (AH/l) Kinds of ion | 0 Sn Zn g/l | 20 Sn Zn g/l | 40 Sn Zn g/l | 60 Sn Zn g/l | 80 Sn Zn g/l | 100 Sn Zn g/l | 120 Sn Zn g/l |
|---|---|---|---|---|---|---|---|
| K | 16 6 | 18 7 | 20 9 | 18 9 | 17 8 | 18 7 | 18 8 |
| L | 16 6 | 20 8 | 26 11 | 24 10 | 28 11 | 30 12 | 27 11 |

We claim:

1. A method for stabilizing tin or tin alloy electroplating baths which contain citric acid or its salt and an ammonium salt, characterized by adding in the bath as a stabilizer at least one saturated hydrocarboxylic acid or its salt other than citric acid and citrate and/or at least one saturated dibasic carboxylic acid or its salt.

2. A method as claimed in claim 1, wherein the saturated hydrocarboxylic acid other than citric acid is selected from the group consisting of tartaric acid, malic acid, glycollic acid, glyceric acid, lactic acid and $\beta$-hydroxypropionic acid.

3. A method as claimed in claim 1, wherein the salt of saturated hydrocarboxylic acid other than citrate is selected from the group consisting of sodium, potassium and ammonium salts of tartaric acid, malic acid, glycollic acid, glyceric acid, lactic acid and $\beta$-hydroxypropionic acid.

4. A method as claimed in claim 1, wherein the saturated dibasic carboxylic acid is selected from the group consisting of oxalic acid, malonic acid, succinic acid, glutaric acid and adipic acid.

5. A method as claimed in claim 1, wherein the salt of saturated dibasic carboxylic acid is selected from the group consisting of sodium, potassium and ammonium salts of oxalic acid, malonic acid, succinic acid, glutaric acid and adipic acid.

6. A method as claimed in claim 1, wherein the stabilizer is added in the bath in the amount of 5 to 30 g/l.

7. A method as claimed in claim 1, wherein pH value of the bath is set in a range of 4 to 8.

8. A method as claimed in claim 7, wherein pH value of the bath is set about at 6.

* * * * *